United States Patent [19]

Wada

[11] 4,287,550

[45] Sep. 1, 1981

[54] DRIVING CIRCUIT FOR PRINTING DEVICE IN ELECTRONIC CASH REGISTER

[75] Inventor: Yasuhiro Wada, Niiza, Japan

[73] Assignee: Copal Company Limited, Tokyo, Japan

[21] Appl. No.: 134,334

[22] Filed: Mar. 26, 1980

[30] Foreign Application Priority Data

Mar. 30, 1979 [JP] Japan ..... 54-41323[U]

[51] Int. Cl.[3] ..... H01H 47/00

[52] U.S. Cl. ..... 361/167; 361/166; 361/191; 307/41; 400/61

[58] Field of Search ..... 361/167, 168, 169, 191; 307/41, 38; 400/61, 71

[56] References Cited

U.S. PATENT DOCUMENTS 3,398,330 8/1968 Poole ..... 361/167

4,128,856 12/1978 Macleod ..... 361/167

*Primary Examiner*—J. D. Miller

*Assistant Examiner*—L. C. Schroeder

*Attorney, Agent, or Firm*—Cushman, Darby & Cushman

[57] ABSTRACT

A driving circuit for printing devices in an electric cash register comprising a pair of first diodes which are connected in series in the normal direction respectively with a journal printing magnet and receipt printing magnet paired with each other and are connected with each other, a first switching transistor connected between the connecting point of the pair of first diodes and a negative (−) terminal of a current source, a second diode connected in the reverse direction between said connecting point and a positive (+) terminal of the current source, a second switching transistor connected between a common feeding line to the journal printing magnets and the positive (+) terminal of the current source and a third switching transistor connected between a common feeding line to the receipt printing magnets and the positive (+) terminal of the current source, to simplify the circuit formation and reduce the manufacturing cost.

3 Claims, 3 Drawing Figures

DRIVING CIRCUIT FOR PRINTING DEVICE IN ELECTRONIC CASH REGISTER

BACKGROUND OF THE INVENTION (a) Field of the Invention

This invention relates to a circuit for driving both printing devices in an electronic cash register having a journal printing device and receipt printing device.

(b) Description of the Prior Art

In a cash register, there are required a journal printing device for continuously recording sales and a receipt printing device for making receipts to be issured to buyers. These two kinds of printing devices print the same contents on journal paper and receipt paper. However, in a conventional cash register, respective driving circuits to be used for the journal printing device and receipt printing device are wired in separate systems to be operated respectively separately. This is based on the reason that the objects of using the journal printing device and receipt printing device are differnt from each other. That is to say, the journal printing device is used to make records to be preserved and, therefore, for example, the date may well be printed only at the time of the first printing every day. Therefore, in the case of the subsequent printing operation for the day, when the date is to be printed, the driving circuit should be preferably cut off. On the other hand, the receipt printing device must be operated at any time as required. Therefore, it is preferable that the driving circuit for the receipt printing device can be switched to be operative and inoperative separately from the driving circuit for the journal printing device.

FIG. 1 shows a conventional driving circuit of this kind. In the drawing, symbols $J_1$, $J_2$, . . . indicate journal printing driving circuits and $R_1$, $R_2$, . . . indicate receipt printing driving circuits. $M_1$, $M_2$, $M_3$, $M_4$, . . . indicate magnets (electromagnets) for printing respective figures. $D_1$, $D_2$, $D_3$, $D_4$, . . . indicate spark voltage absorbing diodes connected in parallel respectively with the respective magnets. $Tr_1$, $Tr_2$, $Tr_3$, $Tr_4$, . . . indicate magnet operation controlling transistors connected in series respectively with the respective magnets. In this circuit, now, if a current source is connected only to the journal printing driving circuit and the printing signals of respective required figures are given to the transistors of the corresponding figures, the magnets corresponding to them will be energized, the required types will be selected and the journal paper will be printed. In this case, the printing signals will be given as pulses and therefore a spark voltage will be generated in the magnet when de-energized but will be absorbed by the diode connected in parallel with the magnet. On the other hand, in case a receipt is required, the current source will be connected to the receipt printing driving circuit by a switch not illustrated and the same operation as the above mentioned operation of the journal printing device will be performed. Therefore, the same printing will be made on the journal paper and receipt paper and the receipt paper will be able to be issued as a receipt.

However, according to such circuit system, the same wiring circuits are provided separately and thereby there have been defects that the number of component parts (such as transistors) is large and the manufacturing cost is high. Therefore, in view of this point, such driving circuit as shown in FIG. 2 is suggested as an improvement of the above mentioned circuit system. According to this driving circuit, the circuit portion consisting of the magnet and spark voltage absorbing diode connected in parallel with it is the same as in FIG. 1 but a transistor common to both paired journal printing and receipt printing magnets is connected. That is to say, reverse current preventing diodes Da, Ab, Dc, Dd, . . . are connected in the normal direction in series respectively with the paired journal printing magnets and receipt printing magnets $M_1$, $M_2$, and $M_3$, $M_4$, and further respective transistors Tra, Trb, . . . are connected respectively between the respective connecting points of the paired diodes Da, Db and Dc, Dd and the current source. Therefore, in this case, if either or both of the journal printing driving circuit and receipt printing driving circuit are connected to the current source in advance, when a printing signal of a required figure is given, for example, when a printing signal is given to the transistor Tra for controlling the first figure printing and the transistor is made to conduct in case only the journal printing driving circuit is operative, the magnet M will operate and, in case the receipt printing driving circuit is also operative, the magnet $M_2$ will also operate together to print the respective sheet of paper. In this case, the spark voltages will be absorbed respectively the diodes $D_1$ and $D_2$.

As evident from the above explanation, in the case of FIG. 2, as compared with the case of FIG. 1, there is a disadvantage that, though the number of the transistors for controlling the operation is reduced to be half, the diodes Da, Db, Dc, Dd, . . . for preventing the reverse current are newly required.

SUMMARY OF THE INVENTION

An object of the present invention is to provide a driving circuit for printing devices in an electronic cash register wherein the number of circuit component parts is further reduced to make it possible to reduce the manufacturing cost in view of the above described circumstances.

According to the present invention, to attain this object, a pair of first diodes are connected in the normal direction in series respectively with a journal printing magnet and receipt printing magnet paired with each other, a first switching means is connected between the connecting point of one and the other of the pair of first diodes and one terminal of a current source, a second diode is connected in the reverse direction between said connecting point and the other terminal of the current source, a second switching means is connected between the journal printing magnet and current source and a third switching means is connected between the receipt printing magnet and current source.

This and other objects of the present invention will become more apparent during the course of the following detailed description and appended claims.

DESCRIPTION OF THE PREFERRED EMBODIMENT

Figure 1:
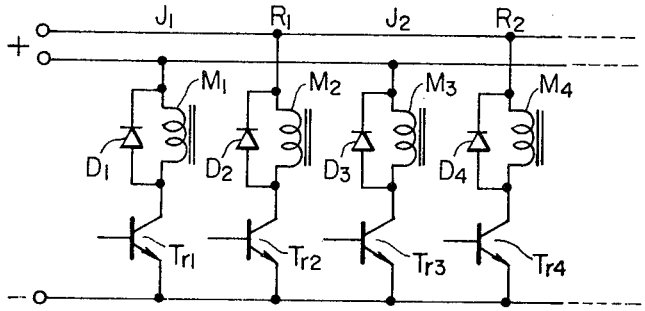
FIG. 1 PRIOR ART
FIG. 1 is a wiring diagram showing a conventional fundamental driving circuit.
Figure 2:
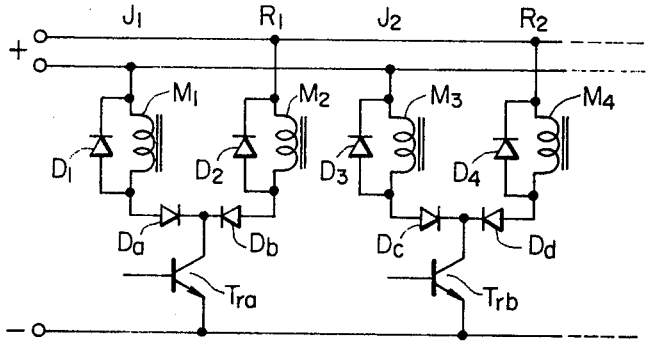
FIG. 2 PRIOR ART
FIG. 2 is a wiring diagram showing a conventional improved driving circuit.
Figure 3:
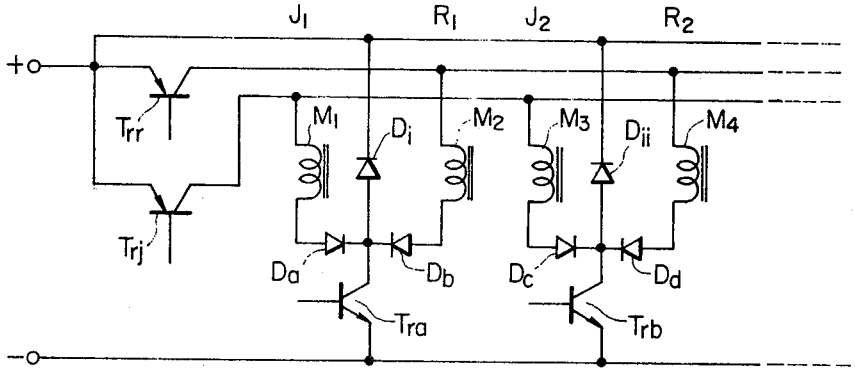
FIG. 3 is a wiring diagram showing an embodiment of a driving circuit according to the present invention.

In FIG. 3 is shown an embodiment of a driving circuit according to the present invention. Here the same symbols are attached to the same respective component parts as are shown in FIG. 2 and the component parts already described with reference to FIG. 2 are omitted in the explanation. In the drawing, symbol Trj indicates a switching transistor connected between the common feeding line to the journal printing magnets $M_1$, $M_3$, . . . and a positive (+) terminal of a current source and Trr indicates a switching transistor connected between the common feeding line to the receipt printing magnets $M_2$, $M_4$, . . . and the positive (+) terminal of the current source. Symbol Di indicates a spark voltage absorbing diode connected in the reverse direction to the current source between the connecting point of the diodes Da and Db and the positive (+) terminal of the current source. Dii indicates a spark voltage absorbing diode connected in the reverse direction to the current source between the connecting point of the diodes Dc and Dd and the positive (+) terminal of the current source. The magnets $M_1$ and $M_2$ and magnets $M_3$ and $M_4$ are respectively paired. The number of these pairs depends on the capacity of the register, that is, on the number of the maximum printable figures. For example, the magnets $M_1$ and $M_2$ are used to print the first figure on the journal paper and receipt paper and the magnets $M_3$ and $M_4$ are used to print the second figure.

The operation of this circuit is as follows.

In printing, when a signal is first put into the base of the transistor Trj to make it conduct, the journal printing magnets $M_1$, $M_3$, . . . will become ready to operate. Therefore, when a printing signal is put into the base of the transistor Trb to print a required figure to be printed, for example, the second figure, the transistor Trb will conduct to energize the magnet $M_3$. By the energization of the magnet $M_3$, a printing hammer not illustrated will operate to print in the position corresponding to the second figure on the journal paper. In this case, the spark voltage generated in the magnet $M_3$ will be absorbed by the closed circuit formed of the diodes Dc and Dii as a result. Also, in order to make the receipt printing driving circuit operative, a signal may be given to the base of the transistor Trr to make it conduct. In this case, the operations of the respective printing magnets $M_2$, $M_4$, . . . are the same as in the above described case and therefore shall be omitted in the explanation.

The transistors Trj and Trr may be replaced with such other switching means as SCR and mechanical switches.

As described above, according to the present invention, there is an advantage that, as more circuit component parts are used in common, the entire driving circuit can be manufactured at a very low cost.

I claim:

1. A driving circuit for printing devices in an electronic cash register comprising a plurality of pairs of journal printing magnets and receipt printing magnets arranged adjacently and independently of each other, a pair of first diodes which are connected in the normal direction in series respectively to said respective magnets in a pair and are connected with each other, a first switching means connected between the connecting point of said pair of first diodes and one terminal of a current source, a second diode connected in the reverse direction between said connecting point and the other terminal of said current source, a first feeding line connected in common to said plurality of journal printing magnets, a second switching means connected between said first feeding line and said current source, a second feeding line connected in common to said plurality of receipt printing magnets, and a third switching means connected between said second feeding line and said current source.

2. A driving circuit according to claim 1 wherein said first switching means comprises a transistor made to conduct by a printing signal input.

3. A driving circuit according to claim 1 wherein said second and third switching means comprise respective transistors.

* * * * *